United States Patent [19]

Chen

[11] Patent Number: 4,786,199

[45] **Date of Patent: * Nov. 22, 1988**

[54] SHAVING BRUSH

[76] Inventor: Teng-Mo Chen, 12-1 Lane 105, Hang-Chow S. Rd. Sec. 1, Taipei, Taiwan

[ * ] Notice: The portion of the term of this patent subsequent to Jun. 23, 2004 has been disclaimed.

[21] Appl. No.: 741,225

[22] Filed: Jun. 4, 1985

Related U.S. Application Data

[63] Continuation-in-part of Ser. No. 568,257, Jan. 4, 1984, abandoned.

[51] Int. Cl.[4] ..... A46B 11/00

[52] U.S. Cl. ..... 401/288; 401/270; 401/282; 401/277

[58] Field of Search ..... 401/286, 288, 282, 277, 401/270, 271, 186

[56] References Cited

U.S. PATENT DOCUMENTS

| | | | |
|---|---|---|---|
| 588,047 | 8/1897 | Arbuckle | 401/277 |
| 717,251 | 12/1902 | McMillan . | |
| 737,471 | 8/1903 | Platner | 401/277 |
| 1,007,816 | 11/1911 | Stubenrauch | 401/286 |
| 1,056,538 | 3/1913 | Hawes . | |
| 1,092,656 | 4/1914 | Lyman . | |
| 3,256,550 | 6/1966 | Laxalt . | |
| 3,378,331 | 4/1968 | Beasley | 401/286 |
| 4,348,126 | 9/1982 | Nigro . | |
| 4,674,903 | 6/1987 | Chen | 401/277 X |

FOREIGN PATENT DOCUMENTS

| | | | |
|---|---|---|---|
| 715757 | 12/1941 | Fed. Rep. of Germany | 401/288 |
| 362076 | 8/1938 | Italy | 401/286 |

*Primary Examiner*—Steven A. Bratlie

*Attorney, Agent, or Firm*—Cushman, Darby & Cushman

[57] ABSTRACT

An improved instant shaving lather forming brush includes a container which is to be filled with liquid soap. The container is joined with a specially structured brush body that completes a one touch system by matching the characteristics of a brush capable of containing a large amount of water. The inherent nature of the soap will produce a massive lather after it contacts the water and is brushed on one's face, thus achieving the lather required for shaving. In particular, the present invention is applicable to a brush having long hair (above 2.5 cm). The specially structured brush body includes a flexible central guide tube and a pad plate which controls the opening and closing of the flow of liquid soap through the guide tube to outermost ends of the brush hair.

2 Claims, 2 Drawing Sheets

SHAVING BRUSH

CROSS REFERENCES TO RELATED APPLICATIONS

This application is a continuation-in-part of application Ser. No. 568,257 filed on Jan. 4, 1984 now abandoned.

BACKGROUND OF THE INVENTION

1. Field of the Invention

The present invention relates to an improved shaving lather forming brush, the structural features of which lie in that it has a uniquely designed pad plate to control the opening and closing of the liquid soap flow and that a central guide tube has a unique installation structure.

2. Description of the Prior Art

Soap is a necessary item during shaving, since we have recognized its cleaning power and lubricative nature by penetrating into the pores to help our shaving. In the conventional way of creating lather, soap (bars or powders) and a small amount of water are placed in a bowl container with a rim, and then the solution is stirred with a brush to produce the lather needed for shaving before it is applied to the beard to be shaved.

Later on because one has to get all the items such as container, brush, soap and water ready, it is very troublesome and has been, therefore, gradually given up in favor of the aerosol method which uses a lather filled with a gas. In this method, the soap solution is first filled in a specially made container and then a gas is also injected into such a container for storage. During use, a special button is pushed down to make both the soap solution and gas spray out together at the same time because the container holds a large quantity of gas. The soap solution rapidly expands and produces a large volume of lather during the spraying of such soap solution and gas.

From the above-said two methods, we can understand that, although the measures are different, their object is to generate lather for shaving. Each of the two methods has advantages and disadvantages of its own. First, to talk about the conventional method, its greatest disadvantage is that it is necessary to get the container, brush, soap and water ready and a continued stirring must be applied to the soap solution to generate lather for shaving. Thus, this way is troublesome and inconvenient. Contrarily, this conventional method uses a brush most valuable to shaving as such a brush can be used to stir the soap solution in the container to generate lather and also to repeatedly brush the beard to remove and clean the dirt and all the grease thereon, thereby facilitating the shaving process. If the brush is wet with hot water for use, it is helpful to soften the beard and thus facilitates shaving.

Now we discuss the aerosol method of creating lather which is most widely used at present, since one does not need to get any container and brush ready, thus saving a lot of trouble, and during use, one only needs to depress its button to easily get the lather needed for shaving. Hence this is, indeed, labor-saving and convenient. However, its defects outweigh its merits, because it is important to inject a gas into the soap solution contained in the container which must be made of a pressureresistant material. If the container is placed close to a flame, a hazard of explosion appears.

In addition to the added costs of the abovesaid specially made container and button, the volume of such a container must be increased to meet the needs of the injected gas, so a similar smaller-sized finished product cannot be made feasible and therefore this causes uneconomy in its packing and transportation.

The aerosol method not only is disadvantageous in costs and storage of the products but also, if compared in practicability with the conventional method, has many defects, i.e. since the lather produced by the conventional method contains more water and less gas, the lather can easily adhere to and deeply penetrate the beard roots. The lather also has a better cleaning and degreasing strength and facilitates razor blade travel. Such lather further makes shaving more comfortable and cleaner, but the lather produced by the aerosol method often contains less water and is sprayed out together with two much gas. Furthermore, the aerosol lather expands in an excessive manner, but lacks adhesive and penetrative power. It therefore merely stays on the beard tips without deeply penetrating the beard roots without any evident effects. Unless the lather is kneaded and applied by the user's hand or applied with a heated towel as a supplementary means, the lather is not very helpful to shaving.

The fountain type brushes for personal use are generally known, but most of their structures differ from that of the present invention, for instance, in U.S. Pat. No. 3,256,550 issued June 21, 1966 to J. N. Laxalt, U.S. Pat. No. 1.056,538 issued Mar. 18, 1913 to D. H. HAWES, and U.S. Pat. No. 717,251 issued Dec. 30, 1902 to H.P. McMILLAN. As to their ways of controlling the opening and closing of the liquid flow, the corresponding opposite holes are used by all of them, i.e. a hole is provided in the hair brush body and another corresponding hole is also provided in the outlet in the container. When the hair brush body is turned to make its hole aligned to the hole in the container in staggered positions, they are in a closed state. Further, in U.S. Pat. No. 1,092,656 issued Apr. 7, 1914 to J. Lynam, the movement of a slot is used to shut or open the outlet hole in the container. All these prior art arrangements are different from the pad plate of the present invention. As to U.S. Pat. No. 4,348,126 issued Sept. 7, 1982 to L. V. NIGRO, although a central guide tube is shown therein, its installation and securement is completely different from that of this invention, and the flowing of the liquid out of its container is by a push of a piston, but this present invention does not have anything as such piston.

SUMMARY OF THE INVENTION

The present invention provides an improved instant shaving lather forming brush. A container filled with a soap solution is joined to a brush body. During use, the soap solution can be directly squeezed out through the brush which applies the lather to the beard, thus rapidly forming a massive lather thereon for shaving. Therefore, the present invention serves as an improved brush of the one touch system.

The present invention is adapted to a high lather-forming degree and also is useful with a long hair type brush (above 2.5 cm). The construction of its brush body comprises a central guide tube, the opening and closing of the flow and a pad plate mainly controlling the liquid soap. The central tube is made of a rubber material. Its bottom forms a protruding ring-shaped loop to be inserted into the concave ring of the bottom face in the central hole of the brush body. Protruding points are provided at higher places respectively on the left and right sides of its lower end. Such two protruding points can be set and fixed on the two sides above the central hole in the brush body to make the guide tube not slip off or move away under external forces. A round pad plate is placed in the brush body, and its bottom face is a plane on which non-continuous ring-shaped convex parts are provided, around the periphery of which a plurality of lateral convex parts are provided to be supported and fixed in the bore of the brush body, while a gap is reserved therein for the liquid soap to flow through.

DETAILED DESCRIPTION OF THE PREFERRED EMBODIMENT

Figure 1:
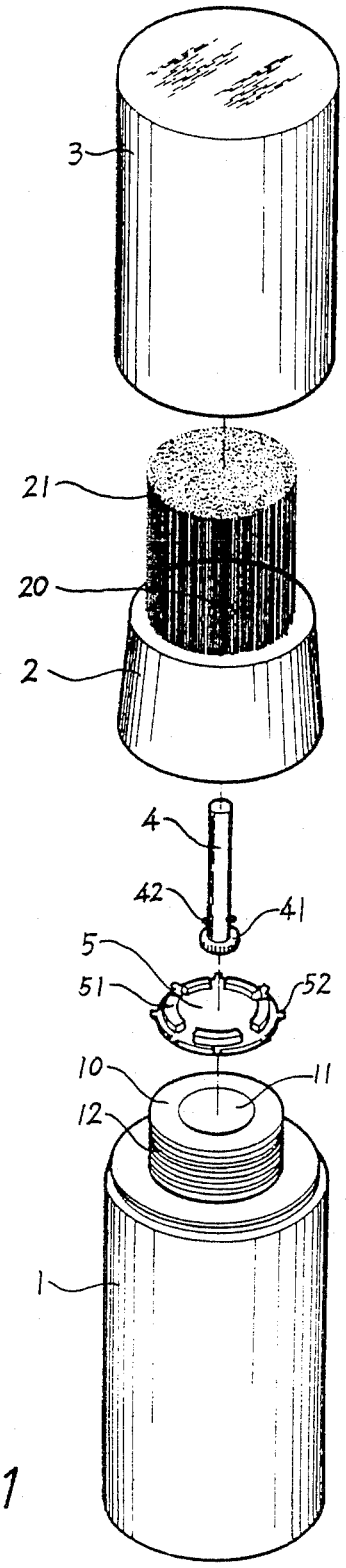
FIG. 1 is an exploded view of the present invention.

After studying various shaving items in great depth, the inventor ascertained that lather is the most valuable item for shaving, and, at the same time, after analyzing the two lather-forming methods, he discovered that there is a lack of continuity between the lather formation of the two methods and the shaving process, i.e. the lather is made in advance in the two methods and is not made simultaneously with the shaving process, thus causing trouble and inconvenience for the user.

Hence, the inventor studied and developed a previous "one touch system" instant lather forming brush. Such a one touch instant lather shaving forming device made the lather formation and the shaving process become an integrated operation, applicable at any time when it is needed, unlike the conventional method, with no need to get any items such as container, soap, or water ready before hand and, also quite unlike the aerosol method, with no need to inject gas into any specially made container with a special button. Therefore, the packing volume of the present invention can be greatly reduced for easy carrying and use at any time by the user. Further, the lather produced by this new method is similar to that produced by the conventional method in quality and contains much water and less gas, and if coupled with hot water in use, it is a top class lather for shaving as well as a most economical and convenient product.

When studying the invention of the previous "one touch system" and repeatedly making further improvements on it, the invention has discovered that the brush hair length has an absolute impact on the lather forming degree, i.e. the lather production volume, and, in other words, when the brush hair length in an applicable scope is above 2.5 cm, the forming degree increased 30% more than that for the brush hair length at 2.0 cm. If and when more effective lather is produced by using soap during shaving, it will be more advantageous to shaving, and in particular, for a man with more beard and mustache. Consequently, as to this shaving brush, the one with longer hair is more suitable.

As to the shaving brush developed under the inventor's previous "one touch system", its liquid soap squeeze outlet hole is provided at the brush root. After penetrating out from the root, the liquid soap flows along the brush hair to their ends. However, it has its defects. First, because the brush hair is longer, the liquid soap adhering to the place close to the hair roots causes a waste of lather, and secondly a larger amount of the liquid soap adhering to the hair roots causes a further waste which also causes stain spots, thereby making the whole brush harder to maintain. Therefore, the problem was recognized as how to effectively and directly introduce the liquid soap to the end of the brush with longer hair without making the liquid soap pass through the brush root and consequently also without adding any waste, but at the same time, the cleanness of the brush must be easily maintained. This problem was solved by a solution which is a key point of the present invention. In response to the problem, the present invention provides a uniquely structured central guide tube.

As to the brush with shorter hair under the inventor's previous "one touch system", due to a lesser volume of the lather produced, it can be used for washing one's face without the need for it to produce more lather. It is particularly suitable for ladies when they wash their faces and remove their make-up because the hair brush according to the present invention has longer hair, which can produce a larger amount of lather. The present invention also is extremely suitable for gentlemen's shaving, because the arrangement of the special central guide tube makes the structure according to this invention very simple, low in manufacturing costs, and also easy to assemble without any defects but having the best practical value. Besides, in addition to achieving the expected larger volume of lather to be produced, it can also obtain the best improved effects in reducing the soap solution consumption rate and maintaining the neatness and cleaness of the brush.

Now the present invention is described in detail with reference to the examples shown in of the drawings as follows.

A perspective exploded view of the present invention is shown in FIG. 1. Its construction includes a container 1, a hair brush body 2, a cover 3, a central guide tube 4, and a pad plate 5. The container 1 can be in any form in which liquid soap or emulsion is stored. Its top has an opening 11 with lip rim 10; threads 12 are also provided around the periphery of this end to thread the brush body 2.

Figure 2:
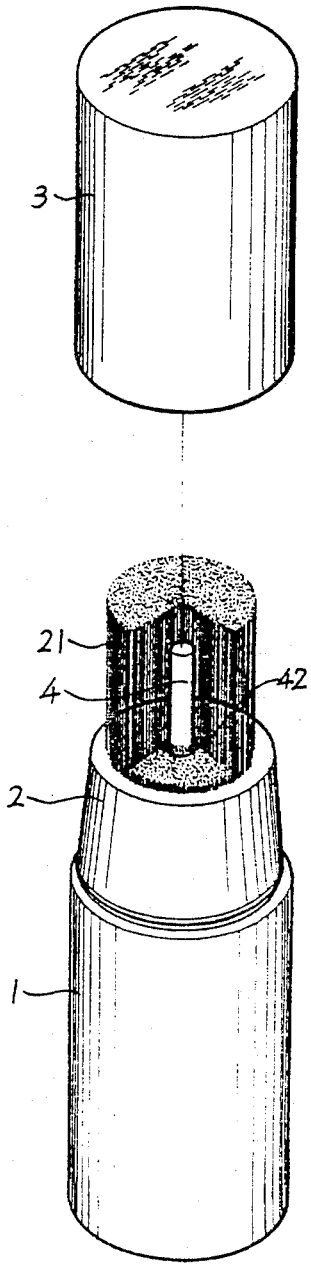
FIG. 2 is a perspective view of the assembled present invention.
Figure 3:
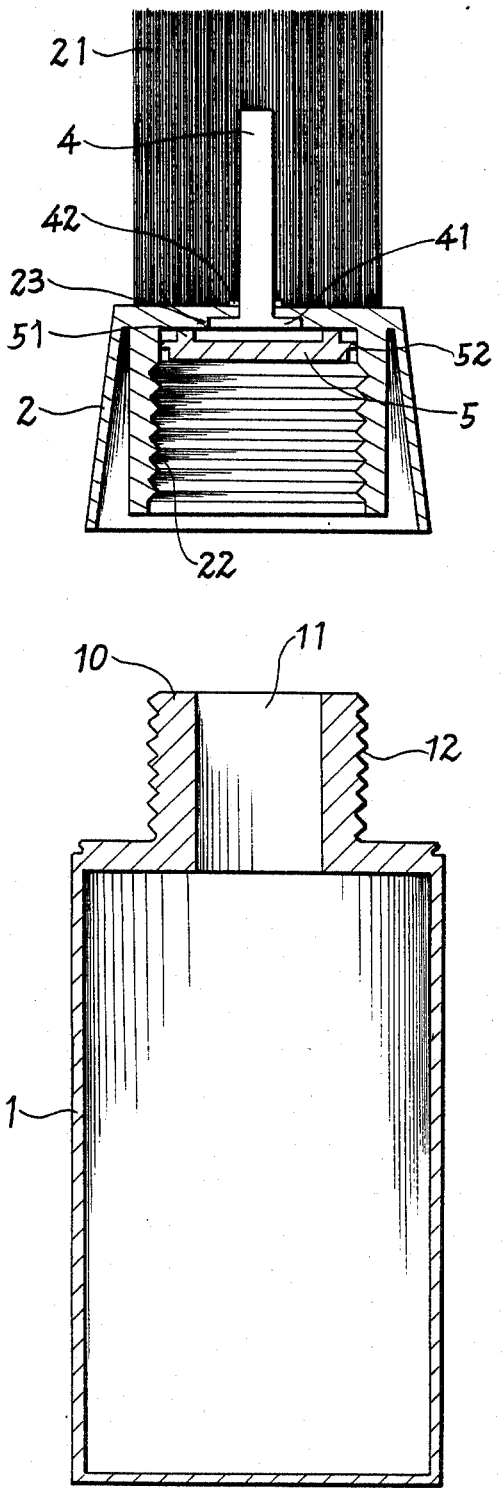
FIG. 3 is a longitudinal sectional view of the present invention.

FIG. 2 shows the perspective cross sectional view of the brush hair part according to the present invention. FIG. 3 shows the side cross sectional view, illustrating the brush body 2 which is actually the threaded cover of the container 1 and which has brush hair on it. The threads 22 inside mutually engage the threads 12 on the top of the container 1. As shown in FIG. 1, the brush body 2 has a central hole 20 to allow the guide tube 4 to pass through. The guide tube 4 is a flexibly soft rubber hose that functions without adversely affecting the brushing operations of the brush and has a ring-shaped protruding loop 41 on its lower end. A left protruding point and a right protruding point 42 are provided on the respective right and left sides at the lower end, to coordinate the passing through of the guide tube 4. The periphery of the central hole 20 in the inner bottom face of the brush body 2 forms a concave ring 23, as shown in FIG. 3. When the guide tube 4 passes through the central hole 20 shown in FIG. 1, the ring-shaped protruding loop 41 of the guide tube 4 just slides into the concave ring 23, as shown in FIG. 3, thus making the bottom of the guide tube 4 just become flat and even with the inner bottom face of the brush body 2. The left and right two protruding points 12 of the guide tube 4, as shown in FIG. 1, also rest on the two sides of the central hole 20 in the brush body 2. When the brush body 2 is pulled upward, this also makes the guide tube 4 not drop down but remain fixed on the brush body 2. Furthermore, it is preferable that the length of the guide tube 4 is approximately long enough to reach the end of the brush hair length, thereby making the liquid soap adequately flow out along the guide tube 4 to the ends of the brush hair.

Pad plate 5 is set inside the inner part of the brush body 2 and its bottom face is a plane, on which non-continuous ring-shaped protruding parts 51 are provided to make the pad plate 5 and the inner bottom face of the brush body 2 keep a gap therebetween for the liquid soap to flow through without forming any tight closure. Furthermore, a plurality of lateral protruding parts 52 are also provided on the periphery of the pad plate 5 to make the pad plate supported and fixed on the bore of the brush body 2 without falling off, and, at the same time, its periphery also forms a gap to make the liquid soap flow through.

The pad plate 5 has the function of controlling the flow of the liquid soap, i.e. when the brush body 2 is screwed up tightly, the opening 11 of the container 1 closely sticks to the bottom face of the pad plate 5 by its lip rim 10 so as to make the lip rim 10 close the opening 11 completely. When desired to use it again, the user slightly unscrews the brush body 2 to make the lip rim 10 of the opening 11 of the container 1 move away from the bottom part of the pad plate 5. Under the applied force or at the upside-down position of the container 1, the liquid soap directly flows out along the periphery of the pad plate 5 and also along the gap at the top of the pad plate 5 to the end of the brush hair 21 via the central tube 4. Upon completion of the use of the brush, the cover 3 is to be replaced on the brush body 2 to protect the brush and to maintain its neatness and cleanliness.

I claim:

1. An improved instant shaving lather forming brush comprising:

a container having an opening with a lip rim on its one upper end and also having threads on its outer periphery, in which a liquid soap or other applicable emulsion is filled and stored;

a brush body having brush hair, inside which brush body threads are provided to mutually engage the threads on the upper end of the container, said brush body also having a central hole provided in its center;

a central flexible guide tube, provided for passage through the central hole, at the lower end of which a ring-shaped protruding loop is provided, and at least one protruding means being provided at left side and right sides of the tube at a place slightly higher than the protruding loop at the lower end of the tube;

a pad plate provided inside the brush body above the opening of the container, the bottom of said pad plate being a plane, the top of said pad plate having ring-shaped noncontinuous protruding parts, and the periphery of said pad plate having a plurality of lateral protruding parts provided to serve as a means for controlling opening and closing of the flow of the liquid soap in the container through the tube to the brush hair; and a cover adapted to be secured on the outer periphery of the container.

2. The brush as recited in claim 1, wherein a periphery of the central hole inside a bottom face of the brush body forms a concave ring, so that, when the tube passes through the central hole from the bottom face of the brush body, the ring-shaped protruding loop on the lower end of the tube just fits in the concave ring, while the at least one protruding means at left and right sides of the tube just rests on both sides of a top face of the brush body around the periphery of the central hole, and the length of the tube is almost long enough to reach outermost ends of the brush hair.

* * * * *